United States Patent [19]

Hagel et al.

[11] 4,246,052

[45] Jan. 20, 1981

[54] MONO- AND DINITRODIHYDROXYDIAZOBENZENES

[75] Inventors: Rainer Hagel, Lichtenfels; Klaus Redecker, Nuremberg, both of Fed. Rep. of Germany

[73] Assignee: Bayer Aktiengesellschaft, Leverkusen, Fed. Rep. of Germany

[21] Appl. No.: 11,466

[22] Filed: Feb. 12, 1979

[30] Foreign Application Priority Data

Feb. 16, 1978 [DE] Fed. Rep. of Germany ..... 2806599

[51] Int. Cl.[3] ..... C06B 41/00; C06B 41/10; C06B 25/04; C07C 113/00

[52] U.S. Cl. ..... 149/23; 260/141; 260/142; 149/25; 149/105

[58] Field of Search ..... 260/141 D, 142; 149/25, 149/23, 105

[56] References Cited

U.S. PATENT DOCUMENTS

| | | | |
|---|---|---|---|
| 1,572,715 | 2/1926 | Günther et al. | 260/142 |
| 1,840,333 | 1/1932 | Schmidt | 260/142 |

*Primary Examiner*—Paul F. Shaver

*Attorney, Agent, or Firm*—Sprung, Felfe, Horn, Lynch & Kramer

[57] ABSTRACT

Metallic or ammonium salts of diazotized mono or dinitrodihydroxyaminobenzenes are disclosed wherein the corresponding aminonitrodihydroxybenzene has the formula

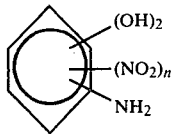

where n equals 1 or 2. The amino group is diazotized to form the diazotized mono or dinitrodihydroxyaminobenzene from which the metallic or ammonium salt is formed. Disclosed in the application are metallic or ammonium salts of diazotized mono or dinitrodihydroxyaminobenzenes, processes for their preparation and their use as igniting agents for priming compositions and explosives.

14 Claims, No Drawings

MONO- AND DINITRODIHYDROXYDIAZOBENZENES

BACKGROUND OF THE INVENTION

1. Field of the Invention

This invention relates to metal salts of mono and dinitrodihydroxydiazobenzenes. More especially, this invention is directed to such metallic salts, to the process for their preparation by a selective reduction of polynitrodihydroxybenzenes to aminonitrodihydroxybenzene followed by diazotization and salt formation. This invention is also directed to the use of the resultant metallic salts as igniting agents for priming compositions and explosives.

2. Discussion of the Prior Art

Commonly known are unsubstituted diazodinitrophenols associated with the structural formula

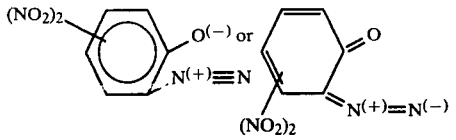

These compounds are used for priming of explosives. Their impact is stronger than that of mercuric fulminate, but slightly weaker than that of plumbic azide. The difficulty of obtaining the 4,6-dinitro-compound in sufficient charging-density proves to be a disadvantage. Because of this, the compound has virtually no technical use.

In addition, metal-free primers, such as the above-mentioned diazodinitrophenols or the also well known dihydroxybenzenediazonium compound suffer in general practice the disadvantage of exercising too low a charge onto the driving agent to be ignited.

It is an object of this invention to provide a compound whose initiating action is stronger than that of diazodinitrophenols which has sufficient thermal and chemical stability to be employed commercially under normal working conditions. These and other objects of this invention will become apparent from the ensuing disclosure.

SUMMARY OF THE INVENTION

Broadly, this invention contemplates a metallic or ammonium salt of a diazotized mono or dinitrodihydroxyaminobenzene wherein the aminonitrodihydroxybenzene has the formula

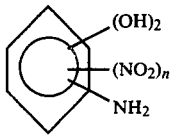

where n equals 1 or 2. It will be realized that the invention resides in a metallic salt of a diazotized aminonitrodihydroxybenzene wherein the amino group shown in the formula above is diazotized. The metallic or ammonium salt is formed by reaction of a metallic or ammonium salt forming substance with the hydroxyl group of the dihydroxybenzene. Theoretical formulae are given below.

One assumes by reason of analogy that the new compounds can be represented by the structural formulae

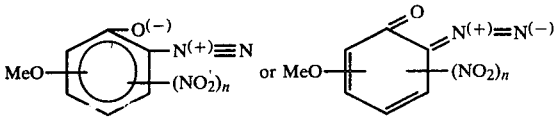

whereby n equals 1 or 2 and Me represents a metal-cation or the equivalent of a metal-cation. The new compounds may correspond in part with the structural formula

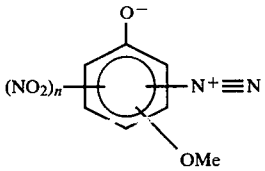

whereby Me and n represents the values mentioned above.

The new metallic salts have a detonation point between 160° and 200° C. In addition, they are highly sensitive to abrasion which makes them suitable for use in igniting and priming agents, especially in thermally charged systems.

Especially suitable for use as igniting and priming agents are the metallic salts of the dinitrodiazodihydroxybenzenes, preferably Na, K- and Ba- salts, as well as lead salt.

Among the new salts of the 4-diazo-2, 6-dinitroresorcin, only the Li- and Mg-salts show acceptable solubility in water. Consequently, these salts may be employed for the preparation of other metallic salts.

Barium- and lead salts from the 4-diazo-2, 6-dinitroresorcin are virtually insoluble in water. The lead salts exist in neutral as well as basic form.

The preparation of the new compounds results in several steps from polynitrodihydroxybenzenes. At first, a nitro group of these compounds is selectively reduced whereby mono- and dinitrodihydroxyaminobenzenes evolve. These compounds are diazotized and the desired metallic salts are produced from the resulting products.

The reduction of the polynitrodihydroxybenzenes can be executed in accordance with generally known processes. In order to obtain high yields of end-products that crystallize well, Sn (II)-compounds are selected as reducing agent. The reduction is executed in a slightly acidic area. Aliphatic carboxylic acids of the short chain type, such as formic or acetic acid are favored as acid. Generally, the pH is 1 to 5.

The reduction takes place under evolution of heat. Since the reaction temperature of this step should not exceed 50° C., an effective cooling of the reaction mixture is necessary. The higher the temperature, the larger the portion of non-crystallizing and dark colored compounds which reduce the yields of the final product. In the preferred form of procedure the temperature during reduction should range between 10° and 30° C.

The amount of the reduction material used should be available according to stoichiometric calculation which results from the required amount for the reduction of a $NO_2$-group inside the molecule of the nitrodihydroxybenzene. It is also advantageous to use an excess amount of nitroaromate for optimum yields. The excess may amount to as much as 20% wt.

The conversion is carried out in a way whereby polynitrodihydroxybenzene, i.e., styphnic acid is inserted into the acid, i.e., acetic acid. By use of cooling agents and a constant temperature ranging between 20° to 30° C., a mixture of the reduction agent, preferably $Sn\ Cl_2$ in water, is slowly dropped into the above mentioned solution. After a post reaction time and completed addition, the reaction mixture is introduced into concentrated hydrochloric acid and purified by filitration from excess starting material.

The reduction is followed by a diazotization of the amino group. The diazotization is done in accordance with generally known processes. One can process the solution of mono- or dinitroaminodihydroxybenzenes in hydrochloric acid, as accrued in the above mentioned first production step of the reaction, without isolation of the intermediate. Thereafter diazotization is effective using known diazotization conditions by adding nitrite.

The third reaction step, the conversion of the diazodinitrodihydroxybenzenes to the corresponding metallic or ammonium salts is also carried out in accordance to known methods. The diazo-compounds are reacted with metallic or ammonium salts of weak aids, such as carbonates, bicarbonates or metallic oxides or -hydroxides. Metallic salts are also obtained by conversion as mentioned above.

If possible, the conversion should take place at room temperature. The pH- value of the solution should stay below 7. A temporary increase of pH values above 7 is possible if one compensates with an immediate reduction of the pH value to below 7. In total, only stoichiometrically necessary amounts of metallic or ammonium salts reacting to base are reacted.

The new mono- and dinitrodihydroxybenzenediazo-compounds, especially their metallic salts, are used essentially as primers for priming and igniting agents. Primers serve as igniting agents for secondary explosives. Priming represents the start of a deflagration, while ignition represents the release of a detonation. Both may be achieved by means of priming agents. In order to differentiate them from secondary explosives one calls them primary explosives.

Among the known priming agents, (next to lead azide, silver azide, mercuric fulminate and leadtrinitroresorcinate) only diazodinitrophenol acquired some particular importance as a metal-free compound. Despite its good qualities, there is hardly any commercial use for it. It possesses a high sensitivity for use in priming and, in comparison to mercuric fulminate, requires a smaller amount of priming agent while achieving better stability. As mentioned above, the difficulty of getting it into chargeable form with sufficient density has proven a detriment.

The limited amount of condensed particles in a priming composition with diazodinitrophenol necessary for an effective ignition after burning is the cause for the limited distribution which diazodinitrophenol has experienced up to the present.

As shown in the following table, the new mono- or dinitrodihydroxybenzene- diazo- compounds and their salts, especially alkali metal and alkaline earth metal salts, proved surprisingly superior to diazodinitrophenol with respect to their sensitivity and thermal stability. The alkali and alkaline earth metal salts show properties of primers containing heavy metals.

| Substance | abrasion sensitivity (kp) | impact sensitivity (Nm)* | Deflagration Point (°C.) |
|---|---|---|---|
| 4-diazo-2,6-dinitroresorcin | 2.4 | 0.8 | 163 |
| salts Na | <0.01 | 1 | 160 |
| K | <0.01 | 0.8 | 176 |
| Ba | <0.01 | 5 | 190 |
| Pb | 0.02 | 0.8 | 185 |
| Comparison: | | | |
| 2-diazo-4,6-dinitrophenol | 1.0 | 0.8[1] | 157[1] |

*Nm = Newton meter

[1]Values of 1.5 Nm (sensitiveness of impact) and 180° C. (deflagration point) stated in the literature are non-reproducable by conventional methods.

The presence of metals leading to non-toxic reaction products increases the amount of the condensed products after burning, whereby the ignitability is improved. When using heavy metal salts, a comparison of the most often used Pb-trinitroresorcinate with the compounds of the invention shows a low count of possible harmful matter.

Mono- and dinitrodihydroxybenzene-diazo compounds, as well as their metallic salts are preferred for use as igniting agents, whereby one nitro group is in o-position to an OH- group. In principle, all mono- and dinitrodihydroxydiazo-compounds derived from nitrated ortho-dioxy-benzene, resorcin or hydroquinone are eligible for use.

Alkali- and alkaline earth metals, ammonium, as well as heavy metals, such as silver or lead useful as cationic components of the salts of the new mono and dinitrodihydroxydiazobenzenes.

According to the invention, compounds capable of substitution are used in priming compositions and in igniting agents. Besides the new salts of dihydroxybenzene-diazo compounds containing nitro groups, these igniting agents can contain other, already known igniting agents, such as lead-trinitroresorcinate, lead azide or diazodinitrophenol. Beyond that such compositions contain oxidizing agents, generally metallic nitrates, such as potassium- or barium nitrate, oxide, i.e., lead dioxide or also chromates, bichromates with potassium ferrocyanide. In addition, they contain reduction agents, such as antimony trisulphide and friction agents of which powdered glass is most important, as well as binding agents.

According to the invention, the amount of the compounds capable of substitution in such priming compositions and igniting agents may range between 1 and 50% wt., preferably between 1 and 15% wt. of the entire composition.

In order to more fully illustrate the nature of the invention and the manner of practicing the same, the following examples are presented (usual safety conditions must be considered):

EXAMPLE 1

(Preparation of the preliminary steps)

In a 5 liter beaker, containing 2.5 liter acetic acid, 430 gm (1.75 Mol) styphnic acid which can be dampened with water is stirred in. Starting at room temperature, a solution of 1 kg $Sn\ Cl_2 \cdot 2H_2O$ (4.43 Mols) in a 1 liter volumed container of water is admixed at a rate of 4 drops per second. The temperature rises slowly and is held at 30° C. by means of cooling. After completed addition, the mixture is stirred for an additional 20 minutes, followed by extreme concentration in the rotation-evaporator (70° C./16 bar). The residue is absorbed with 1000 $cm^3$ of concentrated hydrochloric acid, cooled down to 0° C. and separated from the excess styphnic acid by suctioning through a glass frit. 88 g of unconverted styphnic acid were recovered. The residue is rinsed with concentrated hydrochloric acid and the filtrate is placed into an ice-bath.

At a maximum temperature of 15° C. and agitation with a glass-or porcelain stirrer, a solution of 125 g (1.81 Mol) of $NaNO_2$ in 250 ml water is dropped in such a way under the surface, that nitrous gases escape only toward the end of the reaction. The product is agitated for an additional 30 minutes at a temperature below 15° C., where it remains inactive at room temperature for at least 5 hours, preferably over night, settling to a large extent as a deposit. During suctioning off, the mass is condensed by pressure and first washed free of chlorides with approximately 1 liter 2% vol. sulfuric acid and then washed free of sulfates with approximately 500 ml ice-water and suctioned dry to a large extent.

Yield: approximately 200 g (0.88 Mol)=63.4% in theory (in accordance with converted styphnic acid)

EXAMPLE 2

226 g (1 Mol) 4-diazo-2,6-dinitroresorcin is reacted at room temperature in 1 liter water with 69 g (0.5 Mol) $K_2CO_3$ or 87 g (0.5 Mol) $K_2CO_3 \cdot 2H_2O$ or 100 g (1 Mol) $KHCO_3$ in such a way that addition is done in steps avoiding an excess reagent reacting to base. After a reaction time of 30 minutes the product is suctioned off resulting in a 95% yield of potassium salt.

EXAMPLE 3

As described in Example 2, 226 g (1 Mol) 4-diazo-2,6-dinitroresorcin is reacted with 112 g (0.5 Mol) Pbo in 1.5 liter water. Mixing continues for one hour at room temperature. The resulting Pb-salt is filtered off. The yield is almost quantitative.

EXAMPLES 4 to 6

In multiple accumulations, 226 g (1 Mol) 4-diazo-2,6-dinitroresorcin is mixed with water to form a total volume of 800 ml which is reacted with 21 g (0.5 Mol) Magnesium oxide under agitation and cooling at 20° C. After setting the pH value between 6.5 and 7 of a glass electrode, 166 g (0.5 Mol) Pb $(NO_3)_2$ in 500 ml water or 105 g (0.5 Mol) Ba $Cl_2$ in 500 ml water or 122.5 g (0.5 Mol) $BaCl_2 \cdot 2H_2O$ in 500 ml water, are added.

The crystallization of the reaction product is slightly delayed. The product is stirred for ten minutes, then it is suctioned off and washed free of magnesium. The Pb- and the Ba-salts of the substituted compound amount to a yield of 95 to 98% wt.

EXAMPLES 7 TO 13

The following tables represent ignition charges which contain 55% primings. Example 7 serves as comparative example, where only lead-trizinate is used as priming. In Examples 8 to 12 part of the trizinate is substituted by the salt derived from the invention. Example 13 serves also for the purpose of comparison.

The table explains the increase in sensitivity of an ignition charge with the invented compounds admixed in comparison to a charge containing lead trizinate (Example 7) or in comparison to a charge where the lead trizinate is substituted by diazodi nitrophenol.

| Example # | Ignition-charge Substitution of the lead trizinate by percentage(%) of Ba-or Pb-4-diazo-2,6-dinitro-resorcinate | Abrasion-sensitivity (kp) | Impact-sensitivity (Nm) | De-flagra-tion point (°C.) |
|---|---|---|---|---|
| 7 | 0 (comparison) | 1.4 | 0.2 | 263 |
| 8 | 1 | 0.8 | 0.1 | 263 |
| 9 | 2 | 0.4 | <0.1 | 265 |
| 10 | 3 | 0.2 | <0.1 | 261 |
| 11 | 4 | 0.07 | <0.1 | 264 |
| 12 | 5 | 0.05 | <0.1 | 263 |
| 13 | comparison with diazodinitrophenol | | | |
| | 15 | 1.2 | 0.2 | 160 |

The priming- or ignition charge prepared in such a way can be used in the form of shelled ammunition, such as rim-fired ammunition, blasting caps, detonating caps or detonating fuses. In addition, it can be used without priming caps, i.e., ammunition without shells which are made usable by molding the ignition charge into shape, i.e., by pressing it into form.

EXAMPLES 14 TO 16

A criterion for the effectiveness of a priming- or igniting composition is the sensitivity of the ammunition in response to a drop-hammer (according to methods of the BAM), a so called "run down test" in laboratory stage.

According to this method, primings for rim-fired cartridges were examined, using a drop-weight of 112 g, containing only the known Pb-trizinate as priming composition (Example 14). In a second experiment, 15% of the trizinate was substituted by the known diazodinitrophenol (Example 15). This example also serves for the purpose of comparison. In Example 16, according to the invention, only 5% of the trizinate is substituted from the composition of Example 14 with Ba-4-diazo-2,6-dinitroresorcinate. Using Pb-salt produced analogous results.

Results are combined in the following table. They show that the ignition of a composition depends on the drop-height. When using the substituted compounds according to the invention, one recognizes the desired improvement of ignition sensitiveness.

| Example No. | Number of misfirings per 50 cartridges 6.8/11 at a drop height of . . . inches | | | | | | |
|---|---|---|---|---|---|---|---|
| | 4 | 5 | 6 | 7 | 8 | 9 | 10 |
| 14 | — | 50 | 40 | 25 | 12 | 4 | 0 |
| 15 | 50 | 49 | 37 | 11 | 8 | 4 | 0 |
| 16 | 50 | 41 | 25 | 10 | 2 | 0 | |

What is claimed is:

1. A metallic or ammonium salt of a diazotized mono- or dinitrodihydroxyamino benzene which mono- or dinitrodihydroxyamino benzene has the formula

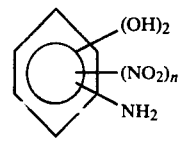

wherein n equals 1 or 2.

2. A metallic or ammonium salt according to claim 1 wherein the metal cation is potassium, barium or lead.

3. A metallic or ammonium salt according to claim 1 wherein the salt is an alkali metal, alkaline earth metal or lead salt of 4-diazo-2, 6-dinitroresorcin.

4. A process for the preparation of a metallic or ammonium salt according to claim 1 which comprises:

A. selectively reducing one of the nitro groups of a polynitrodihydroxy benzene of the formula

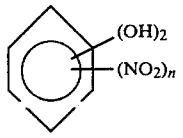

where n equals 2 or 3;

B. diazotizing the resultant amino nitrodihydroxybenzene; and

C. contacting the resultant diazotized amino nitrodihydroxybenzene with a metallic or ammonium salt of a weak acid, a metal oxide, or a metal hydroxide whereby to form a metallic or ammonium salt of a diazotized mono- or dinitrodihydroxyaminobenzene.

5. A process according to claim 4 wherein the reduction is carried out employing a tin compound in a weak acidic solution.

6. In a priming composition comprising an igniting agent and a substance to be primed the improvement wherein said igniting agent is a metallic or ammonium salt according to claim 1.

7. In an explosive composition comprising a material to be exploded and an igniting agent therefore the improvement wherein said igniting agent is a metallic or ammonium salt according to claim 1.

8. A metallic or ammonium salt according to claim 3 wherein the metal is magnesium.

9. A metallic or ammonium salt according to claim 3 wherein the metal is lead.

10. A metallic or ammonium salt according to claim 3 wherein the metal is potassium.

11. A metallic or ammonium salt according to claim 3 wherein the metal is barium.

12. A salt according to claim 1 which is an ammonium salt.

13. A salt according to claim 1 which is a sodium salt.

14. A metallic or ammonium salt according to claim 1 having a detonation point between 160° and 200° C.

* * * * *

UNITED STATES PATENT AND TRADEMARK OFFICE

CERTIFICATE OF CORRECTION

PATENT NO. : 4,246,052

DATED : January 20, 1981

INVENTOR(S) : RAINER HAGEL and KLAUS REDECKER

It is certified that error appears in the above—identified patent and that said Letters Patent is hereby corrected as shown below:

On the cover page of the patent, Item "[73] Assignee:", delete "Bayer Aktiengesellschaft,
Leverkusen, Fed. Rep. of Germany"

and insert

--Dynamit Nobel Aktiengesellschaft,
Troisdorf, Germany--

Signed and Sealed this

*First* Day of *December 1981*

[SEAL]

*Attest:*

GERALD J. MOSSINGHOFF

*Attesting Officer*

*Commissioner of Patents and Trademarks*